US006886634B2

(12) United States Patent
Richards

(10) Patent No.: US 6,886,634 B2
(45) Date of Patent: May 3, 2005

(54) SAND CONTROL SCREEN ASSEMBLY HAVING AN INTERNAL ISOLATION MEMBER AND TREATMENT METHOD USING THE SAME

(75) Inventor: William Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 95 days.

(21) Appl. No.: 10/342,792

(22) Filed: Jan. 15, 2003

(65) Prior Publication Data

US 2004/0134655 A1 Jul. 15, 2004

(51) Int. Cl.[7] ..... E21B 43/08
(52) U.S. Cl. ..... 166/278; 166/227
(58) Field of Search ..... 166/276, 278, 166/51, 236, 227, 228

(56) References Cited

U.S. PATENT DOCUMENTS

| | | | |
|---|---|---|---|
| 2,342,913 A | 2/1944 | Williams et al. | |
| 2,344,909 A | 3/1944 | Williams et al. | |
| 3,486,558 A | 12/1969 | Maxwell | |
| 3,627,046 A | 12/1971 | Miller et al. | |
| 3,865,188 A | 2/1975 | Doggett et al. | |
| 4,418,754 A | 12/1983 | Stepp | |
| 4,494,608 A | 1/1985 | Williams et al. | |
| 4,858,690 A | 8/1989 | Rebardi et al. | |
| 4,886,432 A | 12/1989 | Kimberlin | |
| 4,945,991 A | 8/1990 | Jones | 166/278 |
| 5,082,052 A | 1/1992 | Jones et al. | 166/51 |
| 5,113,935 A | 5/1992 | Jones et al. | 166/51 |
| 5,161,613 A | 11/1992 | Jones | 166/242 |
| 5,161,618 A | 11/1992 | Jones et al. | 166/308 |
| 5,333,688 A | 8/1994 | Jones et al. | 166/278 |
| 5,343,949 A | 9/1994 | Ross et al. | 166/278 |

(Continued)

FOREIGN PATENT DOCUMENTS

| | | |
|---|---|---|
| EP | 0 431 162 | 6/1991 |
| EP | 0 617 195 | 9/1994 |

(Continued)

OTHER PUBLICATIONS

"OSCA Screen Communication System", 1 page, Technical Bulletin.

"OSCA Pressure Actuated Circulating Valve", 1 page, Technical Bulletin.

U.S. Appl. No. 10/252,621, Brezinski et al.

"Mechanical Fluid–Loss Control Systems Used During Sand Control Operations," H.L. Restarick of Otis Engineering Corp., 1992.

(Continued)

*Primary Examiner*—William Neuder
(74) *Attorney, Agent, or Firm*—Lawrence R. Youst

(57) ABSTRACT

A sand control screen assembly (80) that is positionable within a wellbore comprises a base pipe (82) having at least one opening (84) that allows fluid flow therethrough and a filter medium (86) positioned about the exterior of the base pipe (82) that selectively allows fluid flow therethrough and prevents particulate flow of a predetermined size therethrough. An internal isolation member (88) that has at least one opening (90) is positioned within the base pipe (82). A one-way valve (92) is operably associated with the opening (90) of the internal isolation member (88). The one-way valve (92) controls the flow of fluid through the opening (90) of the internal isolation member (88) such that fluid flow is prevented from the interior to the exterior of the sand control screen assembly (80) but is allowed from the exterior to the interior of the sand control screen assembly (80).

37 Claims, 9 Drawing Sheets

U.S. PATENT DOCUMENTS

| | | | | |
|---|---|---|---|---|
| 5,355,956 | A | 10/1994 | Restarick | 166/296 |
| 5,390,966 | A | 2/1995 | Cox et al. | 285/137.1 |
| 5,419,394 | A | 5/1995 | Jones | 166/51 |
| 5,443,117 | A | 8/1995 | Ross | 166/51 |
| 5,476,143 | A | 12/1995 | Sparlin et al. | 166/233 |
| 5,515,915 | A | 5/1996 | Jones et al. | 166/51 |
| 5,588,487 | A | 12/1996 | Bryant | 166/51 |
| 5,636,691 | A | 6/1997 | Hendrickson et al. | 166/278 |
| 5,676,208 | A | 10/1997 | Finley | |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,865,251 | A | 2/1999 | Rebardi et al. | 166/278 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 5,988,285 | A | 11/1999 | Tucker et al. | 166/373 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,302,208 | B1 | 10/2001 | Walker et al. | 166/278 |
| 6,343,651 | B1 | 2/2002 | Bixenman | 166/278 |
| 6,371,210 | B1 | 4/2002 | Bode et al. | |
| 6,457,518 | B1 | 10/2002 | Castano-Mears et al. | |
| 6,478,091 | B1 | 11/2002 | Gano | |
| 6,557,634 | B2 * | 5/2003 | Hailey et al. | 166/278 |
| 6,719,051 | B2 | 4/2004 | Hailey, Jr. et al. | |
| 2002/0074119 | A1 | 6/2002 | Bixenman et al. | |
| 2002/0125006 | A1 * | 9/2002 | Hailey et al. | 166/278 |
| 2002/0157837 | A1 | 10/2002 | Bode et al. | 166/334.4 |
| 2002/0189815 | A1 | 12/2002 | Johnson et al. | |
| 2003/0000701 | A1 | 1/2003 | Dusterhoft et al. | |
| 2003/0056947 | A1 | 3/2003 | Cameron | |
| 2003/0056948 | A1 | 3/2003 | Cameron | |
| 2003/0089496 | A1 | 5/2003 | Price-Smith et al. | |
| 2003/0141061 | A1 * | 7/2003 | Hailey et al. | 166/278 |
| 2003/0188871 | A1 * | 10/2003 | Dusterhoft et al. | 166/308 |
| 2004/0035578 | A1 * | 2/2004 | Ross et al. | 166/250.15 |
| 2004/0035591 | A1 * | 2/2004 | Echols | 166/386 |

FOREIGN PATENT DOCUMENTS

| | | | | |
|---|---|---|---|---|
| EP | 0 955 447 | | 11/1999 | |
| EP | 1 132 571 | A1 | 9/2001 | E21B/43/267 |
| GB | 2 371 578 | | 7/2002 | |
| GB | 2 381 021 | A | 4/2003 | |
| GB | 2 381 811 | A | 5/2003 | |
| WO | WO 99/12630 | | 3/1999 | B01D/29/15 |
| WO | WO 00/61913 | | 10/2000 | E21B/43/04 |
| WO | WO 01/14691 | | 3/2001 | E21B/43/08 |
| WO | WO 01/44619 | | 6/2001 | E21B/43/04 |
| WO | WO 02/10554 | A1 | 2/2002 | E21B/43/26 |

OTHER PUBLICATIONS

"Sand Control Screens," Halliburton Energy Services, 1994.

"Frac Pack Technology Still Evolving," Charles D. Ebinger of Ely & Associates Inc.; Oil & Gas Journal, Oct. 23, 1995.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

"CAP$^{SM}$ Concentric Annular Packing Service for Sand Control," Halliburton Energy Services, Inc., Dec. 1999.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF, Society of Petroleum Engineers, Inc., Mar., 2001.

"Quantum Zonal Isolation Tool," pp. 12–13 of Sand Face Completions Catalog.

"Absolute Isolation Systems (AIS) Components" Halliburton Energy Services, Inc., p. 5–28 of Downhole Sand Control Components.

"OSCA HPR–ISO System", 1 page, Technical Bulletin.

"PCT International Search Report"; PCT/US2004/000728; 9 pages.

* cited by examiner

SAND CONTROL SCREEN ASSEMBLY HAVING AN INTERNAL ISOLATION MEMBER AND TREATMENT METHOD USING THE SAME

TECHNICAL FIELD OF THE INVENTION

This invention relates, in general, to a sand control screen assembly positioned in a production interval of a wellbore and, in particular, to a sand control screen assembly having an internal isolation member that prevents fluid flow from the interior to the exterior of the sand control screen assembly.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent to the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

In other cases, it may be desirable to stimulate the formation by, for example, performing a formation fracturing and propping operation prior to or simultaneously with the gravel packing operation. Hydraulic fracturing of a hydrocarbon formation is sometimes necessary to increase the permeability of the formation adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

It has been found, however, that following formation treatment operations, the fluid inside the sand control screen tends to leak off into the adjacent formation. This leak off not only results in the loss of the relatively expensive fluid into the formation, but may also result in damage to the gravel pack around the sand control screen and damage to the formation. This fluid leak off is particularly problematic in cases where multiple production intervals within a single wellbore require treatment as the fluid remains in communication with the various formations for an extended period of time.

Therefore, a need has arisen for an apparatus and a treatment method that provide for the treatment of one or more formations traversed by a wellbore. A need has also arisen for such an apparatus and a treatment method that prevent fluid loss into the formations following the treatment process. Further, need has also arisen for such an apparatus and a treatment method that allow for the production of fluids from the formations following the treatment process.

SUMMARY OF THE INVENTION

The present invention disclosed herein comprises a sand control screen assembly and a treatment method that provide for the treatment of one or more formations traversed by a wellbore. The sand control screen assembly and the treatment method of the present invention prevent fluid loss into the formations following the treatment process. In addition, the sand control screen assembly and the treatment method of the present invention allow for the production of fluids from the formations following the treatment process.

The sand control screen assembly comprises a base pipe having at least one opening that allows fluid flow therethrough and a filter medium positioned about the exterior of the base pipe. The filter medium selectively allows fluid flow therethrough and prevents particulate flow of a predetermined size therethrough. An internal isolation member is positioned within the base pipe. The internal isolation member has at least one opening. A one-way valve is operably associated with the opening of the internal isolation member such that the one-way valve controls fluid flow therethrough. More specifically, the one-way valve prevents fluid flow from the interior to the exterior of the sand control screen assembly and is actuatable to allow fluid flow from the exterior to the interior of the sand control screen assembly.

In one embodiment of the sand control screen assembly of the present invention, the one-way valve is disposed at least partially within the opening of the internal isolation member. For example, the one-way valve may be flush mounted within the opening of the internal isolation member. Alternatively, the one-way valve may extend partially inwardly into the internal isolation member or the one-way valve may extend partially outwardly from the internal isolation member or both.

In one embodiment, the sand control screen assembly may include a one-way valve that is selectively operable to a disabled configuration such that fluid flow from the interior to the exterior of the sand control screen assembly may be enabled. For example, the one-way valve may have a first operating mode wherein the one-way valve prevents fluid flow from the interior to the exterior of the sand control screen assembly and is actuatable to allow fluid flow from the exterior to the interior of the sand control screen assembly and a second operating mode wherein the one-way valve allows fluid flow from the interior to the exterior and from the exterior to the interior of the sand control screen assembly. The one-way valve may be operated from the first operating mode to the second operating mode by, for example, exposing the one-way valve to a preselected differential pressure.

In one embodiment, the sand control screen assembly may include an internal isolation member that is axially shiftable relative to the base pipe between operating and non operating positions. In the operating position, fluid flow from the interior to the exterior of the sand control screen assembly is prevented but fluid flow from the exterior to the interior of the sand control screen assembly is allowed. In the non operating position the internal isolation member may be bypassed to allow fluid flow from the interior to the exterior and from the exterior to the interior of the sand control screen assembly. In another embodiment, the sand control screen assembly may include an internal isolation member that is retrievable from within the base pipe such that fluid flow from the interior to the exterior of the sand control screen assembly may be enabled.

In another aspect, the present invention comprises a downhole treatment method including the steps of locating a sand control screen assembly within a production interval of a wellbore, the sand control screen assembly including a base pipe having at least one opening, a filter medium positioned about an exterior of the base pipe and an internal isolation member positioned within the base pipe that includes at least one opening, pumping a treatment fluid into the production interval and preventing fluid flow from the interior to the exterior of the sand control screen assembly with a one-way valve operably associated with the at least one opening of the internal isolation member.

The present invention also comprises a downhole treatment method that includes the steps of locating a sand control screen assembly within a production interval of a wellbore, the sand control screen assembly including a base pipe having at least one opening, filter medium positioned about an exterior of the base pipe and an internal isolation member positioned within the base pipe that includes at least one opening having a one-way valve operably associated therewith, pumping a treatment fluid into the production interval and taking fluid returns from the exterior to the interior of the sand control screen assembly through the one-way valve, preventing fluid loss from the interior to the exterior of the sand control screen assembly with the one-way valve and allowing production fluid flow from the exterior to the interior of the sand control screen assembly through the one-way valve.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
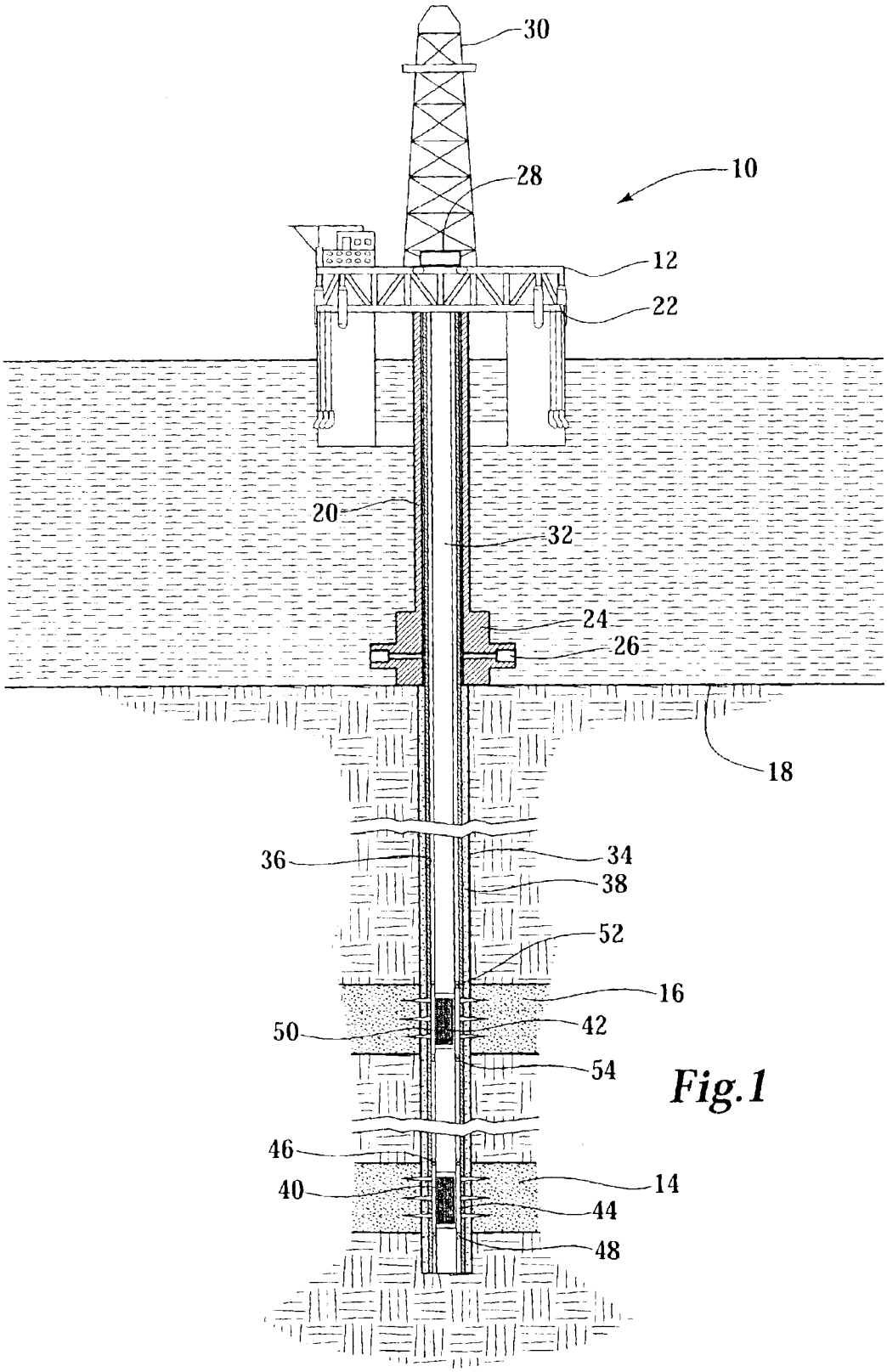
FIG. 1 is a schematic illustration of an offshore oil and gas platform operating a pair of sand control screen assemblies of the present invention.

Referring initially to FIG. 1, a pair of sand control screen assemblies used during the treatment of multiple intervals of a wellbore and operating from an offshore oil and gas platform is schematically illustrated and generally designated 10. A semi-submersible platform 12 is centered over a pair of submerged oil and gas formations 14, 16 located below a sea floor 18. A subsea conduit 20 extends from a deck 22 of the platform 12 to a wellhead installation 24 including blowout preventers 26. Platform 12 has a hoisting apparatus 28 and a derrick 30 for raising and lowering pipe strings such as a work string 32.

A wellbore 34 extends through the various earth strata including formations 14, 16. A casing 36 is cemented within wellbore 34 by cement 38. Work string 32 includes various tools such as a sand control screen assembly 40 which is positioned within production interval 44 between packers 46, 48 and adjacent to formation 14 and sand control screen assembly 42 which is positioned within production interval 50 between packers 52, 54 and adjacent to formation 16. Once sand control screen assemblies 40, 42 are in the illustrated configuration, a treatment fluid containing sand, gravel, proppants or the like may be pumped down work string 32 such that production intervals 44, 50 and formations 14, 16 may be treated, as described in greater detail below.

Even though FIG. 1 depicts a vertical well, it should be noted by one skilled in the art that the sand control screen assemblies of the present invention are equally well-suited for use in wells having other directional orientations such as deviated wells, inclined wells or horizontal wells. Also, even though FIG. 1 depicts an offshore operation, it should be noted by one skilled in the art that the sand control screen assemblies of the present invention are equally well-suited for use in onshore operations. Also, even though FIG. 1 depicts two formations, it should be understood by one skilled in the art that the treatment processes of the present invention are equally well-suited for use with any number of formations.

Figure 2:
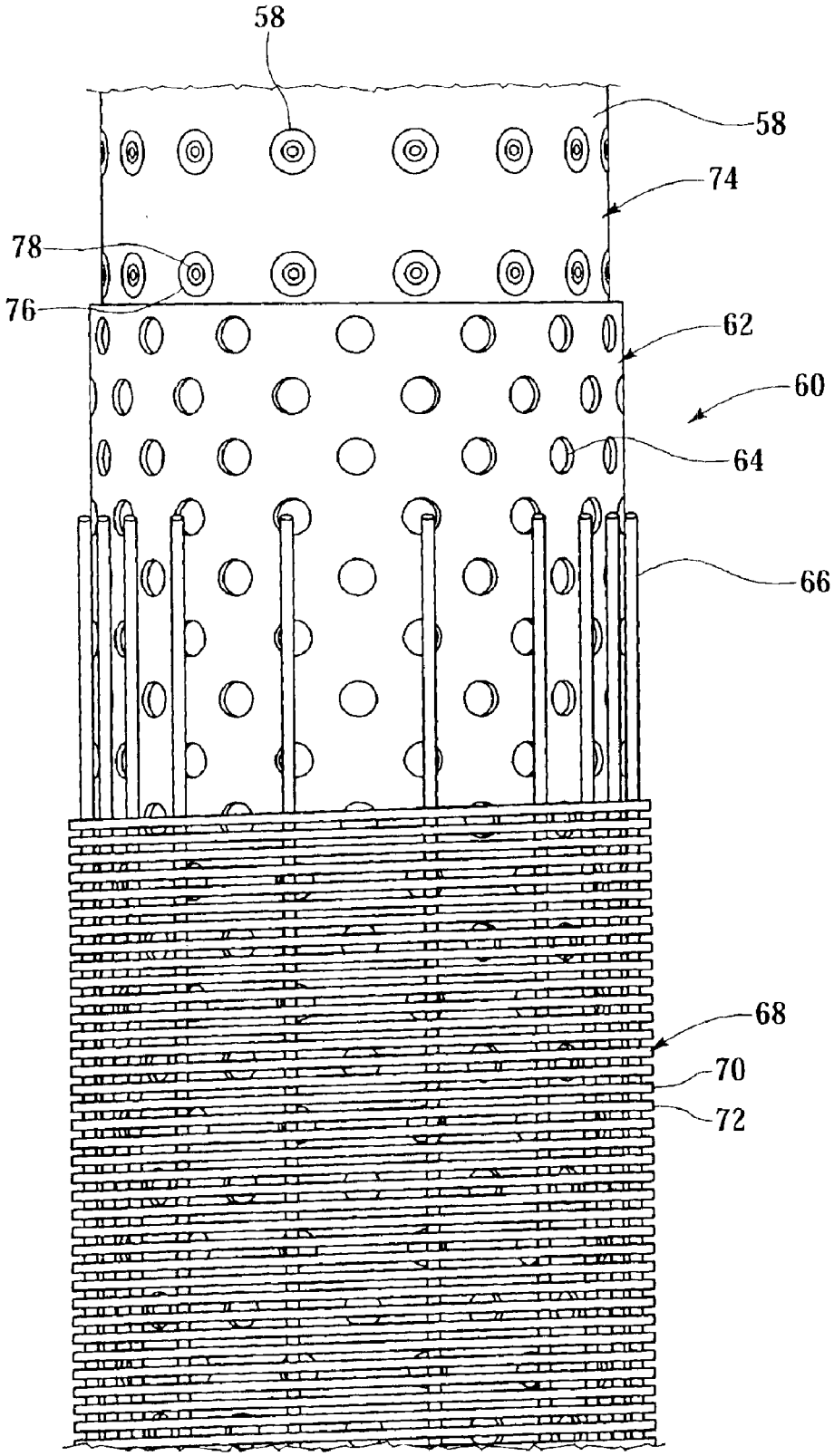
FIG. 2 is a partial cut away view of a sand control screen assembly of the present invention having an internal isolation member disposed within a base pipe.

Referring now to FIG. 2, therein is depicted a more detailed illustration of a sand control screen assembly of the present invention that is generally designated 60. Sand control screen assembly 60 includes a base pipe 62 that has a plurality of openings 64 which allow the flow of production fluids into sand control screen assembly 60. The exact number, size and shape of openings 64 are not critical to the present invention, so long as sufficient area is provided for fluid production and the integrity of base pipe 62 is maintained.

Spaced around base pipe 62 is a plurality of ribs 66. Ribs 66 are generally symmetrically distributed about the axis of base pipe 62. Ribs 66 are depicted as having a cylindrical cross section, however, it should be understood by one skilled in the art that ribs 66 may alternatively have a rectangular or triangular cross section or other suitable geometry. Additionally, it should be understood by one skilled in the art that the exact number of ribs 66 will be dependant upon the diameter of base pipe 62 as well as other design characteristics that are well known in the art.

Wrapped around ribs 66 is a screen wire 68. Screen wire 68 forms a plurality of turns, such as turn 70 and turn 72. Between each of the turns is a gap through which formation fluids flow. The number of turns and the gap between the turns are determined based upon the characteristics of the formation from which fluid is being produced and the size of the gravel to be used during the gravel packing operation. Together, ribs 66 and screen wire 68 may form a sand control screen jacket which is attached to base pipe 62 by welding or other suitable techniques.

Positioned within base pipe 62 is an internal isolation member 74. Internal isolation member 74 includes a plurality of openings 76. A one-way valve 78 is disposed within each opening 76 of internal isolation member 74 to prevent fluid flow from the interior to the exterior of sand control screen assembly 60. Preferably, one-way valves 78 are mounted within openings 76 by threading, stamping or other suitable technique. Ball and seat type one-way valves have been found to be suitable, however, other types of one-way valves may also be used including poppet valves, sleeve valves and the like. One-way valves 78 prevent fluid flow from the interior to the exterior of sand control screen assembly 60 and are actuatable to allow fluid flow from the exterior to the interior of sand control screen assembly 60.

Accordingly, when internal isolation member 74 is positioned within base pipe 62 during a treatment process such as a gravel pack, a frac pack or a fracture operation, treatment fluid returns are allowed to flow into sand control screen assembly 60 through one-way valves 78. Also, when internal isolation member 74 is positioned within base pipe 62 following a treatment process, wellbore fluids are prevented from flowing out of sand control screen assembly 60 by one-way valves 78. Additionally, when internal isolation member 74 is positioned within base pipe 62 during production, production fluids are allowed to flow into sand control screen assembly 60 through one-way valves 78.

It should be understood by those skilled in the art that even though FIG. 2 have depicted a wire wrapped sand control screen, other types of filter media could alternatively be used in conjunction with the apparatus of the present invention, including, but not limited to, a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough.

Figure 3:
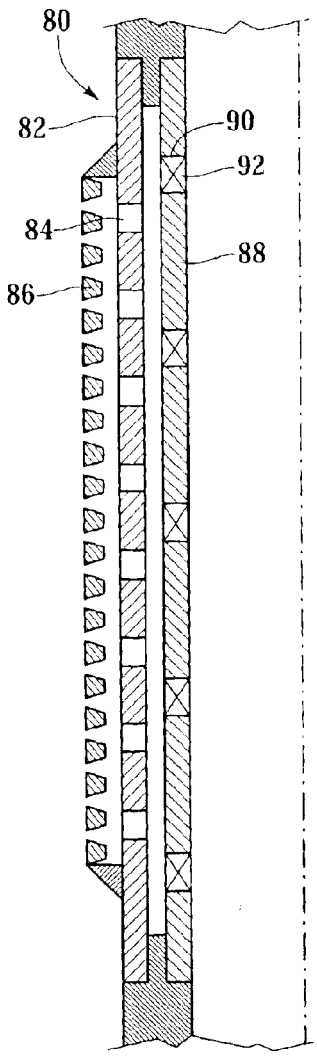
FIG. 3 is a cross sectional view of a sand control screen assembly of the present invention having an internal isolation member including a plurality of one-way valves.

Referring now to FIG. 3, therein is depicted a sand control screen assembly that is generally designated 80. Sand control screen assembly 80 includes base pipe 82 that has a plurality of openings 84, a plurality of ribs (not pictured) and a screen wire 86. Together, the ribs and screen wire 86 form a sand control screen jacket that is attached to base pipe 82 by welding or other suitable techniques.

Positioned within base pipe 82 is an internal isolation member 88. Internal isolation member 88 includes a plurality of openings 90. One-way valves 92 are disposed within each opening 90 of internal isolation member 88 to prevent fluid flow from the interior to the exterior of the sand control screen assembly 80. In the illustrated embodiment, one-way valves 92 are flush mounted within openings 90 by threading, stamping or other suitable technique. One-way valves 92 prevent fluid flow from the interior to the exterior of sand control screen assembly 80 and are actuatable to allow fluid flow from the exterior to the interior of sand control screen assembly 80. Accordingly, one-way valves 92 allow for treatment fluid returns during a treatment process, prevent fluid loss after the treatment process and allow for fluid production once the well is online.

It should be noted that following the treatment processes wherein fluid flow from the interior to the exterior of sand control screen assembly 80 is prevented, the ability to flow fluids from the interior to the exterior of sand control screen assembly 80 may be desirable, for example, to perform an acid treatment. Accordingly, one-way valves 92 may be designed to lock out or be rendered inoperable under certain conditions such that one-way valves 92 no longer prevent fluid flow from the interior to the exterior of sand control screen assembly 80. In such cases, after one-way valves 92 have been operated into the lock out position, fluid flow is allowed from the exterior to the interior and from the interior to the exterior of sand control screen assembly 80. One method of locking out one-way valves 92 is to expose one-way valves 92 to a differential pressure above a predetermined threshold.

Figure 4:
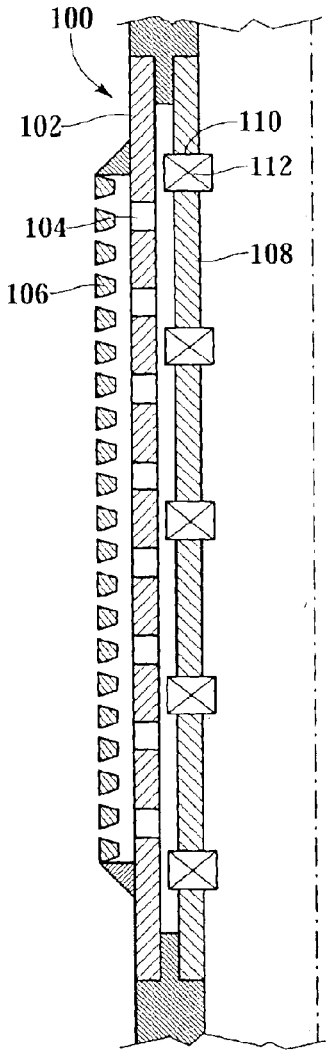
FIG. 4 is a cross sectional view of an alternate embodiment of a sand control screen assembly of the present invention having an internal isolation member including a plurality of one-way valves.

Referring now to FIG. 4, therein is depicted a sand control screen assembly that is generally designated 100. Sand control screen assembly 100 includes base pipe 102 that has a plurality of openings 104, a plurality of ribs (not pictured) and a screen wire 106. Together, the ribs and screen wire 106 form a sand control screen jacket that is attached to base pipe 102 by welding or other suitable techniques. Positioned within base pipe 102 is an internal isolation member 108. Internal isolation member 108 includes a plurality of openings 110.

One-way valves 112 are disposed within each opening 110 of internal isolation member 108 to prevent fluid flow from the interior to the exterior of the sand control screen assembly 100. Preferably, one-way valves 112 are mounted within openings 110 by threading, stamping or other suitable technique. In the illustrated embodiment, one-way valves 112 extend radially inwardly and radially outwardly from openings 110. Due to the thickness of the wall of internal isolation member 108, it may be desirable to use one-way valves 112 that are thicker than the wall of internal isolation member 108. In this case, it has been found that one-way valves 112 may extend radially inwardly, radially outwardly or both from openings 110 without having a detrimental impact on the installation or operation of sand control screen assembly 100 during treatment or production.

Figure 5:
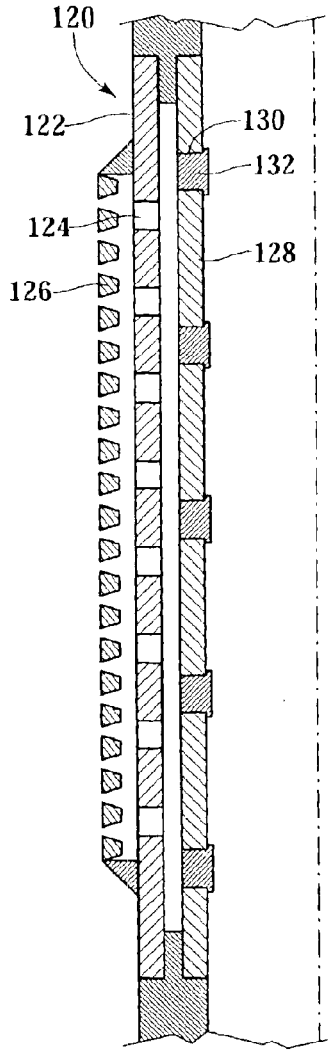
FIG. 5 is a cross sectional view of a sand control screen assembly of the present invention having an internal isolation member including a plurality of plugs.

Referring now to FIG. 5, therein is depicted an alternative embodiment of a sand control screen assembly that is generally designated 120. Sand control screen assembly 120 includes base pipe 122 that has a plurality of openings 124, a plurality of ribs (not pictured) and a screen wire 126. Together, the ribs and screen wire 126 form a sand control screen jacket that is attached to base pipe 122 by welding or other suitable techniques. Positioned within base pipe 122 is an internal isolation member 128. Internal isolation member 128 includes a plurality of openings 130. Disposed within openings 130 is a plurality of plugs 132 that prevent fluid flow through openings 130. Following the downhole treatment processes discussed herein, plugs 132 are removed from openings 130 such that production fluids may flow into the interior of sand control screen assembly 120.

Plugs 132 may be any conventional plugs known or unknown in the art, including metal plugs, such as aluminum plugs, ceramic plugs or the like. The technique used to remove plugs 132 will depend upon the construction of plugs 132. If plugs 132 are formed from an acid reactive material such as aluminum, an acid treatment may be used to remove plugs 132. The acid may be pumped into the interior of sand control screen assembly 120 where it will react with the reactive plugs 132, thereby chemically removing plugs 132.

Alternatively, regardless of the type of plug, plugs 132 may be mechanically removed. For example, a scraping mechanism may be used to physically contact plugs 132 and remove plugs 132 from openings 130. As another alternative, if plugs 132 are constructed from propellants, a combustion process may be used to remove plugs 132. Likewise, if plugs 132 are constructed from friable materials such as ceramics, a vibration process, such as sonic vibrations may be used to remove plugs 132. As a further alternative, plugs 132 may be removed by applying a preselected amount of differential pressure across plugs 132.

Even though the sand control screen assemblies depicted in FIGS. 3–5 each have only one type of sealing device in the respective internal isolation members, it should be understood by those skilled in the art that more than one type of sealing device could alternatively be used in an internal isolation member of a sand control screen assemblies without departing from the principles of the present invention. For example, an internal isolation member of a sand control screen assemblies of the present invention could include both plug and one-way valve. In addition, various types of one-way valve could be used in conjunction with one another in an internal isolation member of a sand control screen assemblies of the present invention.

Figure 6:
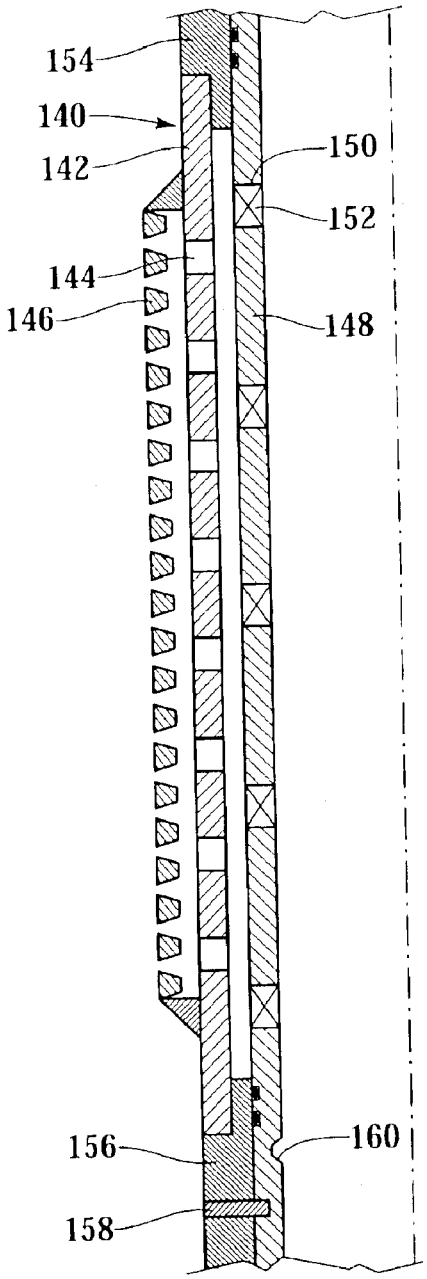
FIG. 6 is a cross sectional view of a sand control screen assembly of the present invention having a retrievable internal isolation member including a plurality of one-way valves.

Referring now to FIG. 6, therein is depicted a sand control screen assembly that is generally designated 140. Sand control screen assembly 140 includes base pipe 142 that has a plurality of openings 144, a plurality of ribs (not pictured) and a screen wire 146. Together, the ribs and screen wire 146 form a sand control screen jacket that is attached to base pipe 142 by welding or other suitable techniques. Positioned within base pipe 142 is an internal isolation member 148 that is retrievable. Internal isolation member 148 includes a plurality of openings 150.

One-way valves 152 are disposed within each opening 150 of internal isolation member 148 to prevent fluid flow from the interior to the exterior of the sand control screen assembly 140. In the illustrated embodiment, internal isolation member 148 sealing engages base pipe connectors 154, 156. In addition, internal isolation member 148 is initially connected to base pipe connector 156 by one or more shear pins 158. Internal isolation member 148 includes a profile 160 that receives a matching profile of a retrieval tool. As discussed above, following the treatment precesses wherein fluid flow from the interior to the exterior of sand control screen assembly 140 is prevented, the ability to flow fluids from the interior to the exterior of sand control screen assembly 140 may be desirable. In the illustrated embodiment, a retrieval tool is run downhole and locked into profile 160 such that jarring in the uphole direction on internal isolation member 148 will break shear pin 158 and allow internal isolation member 148 to be retrieved to the surface.

Figure 7:
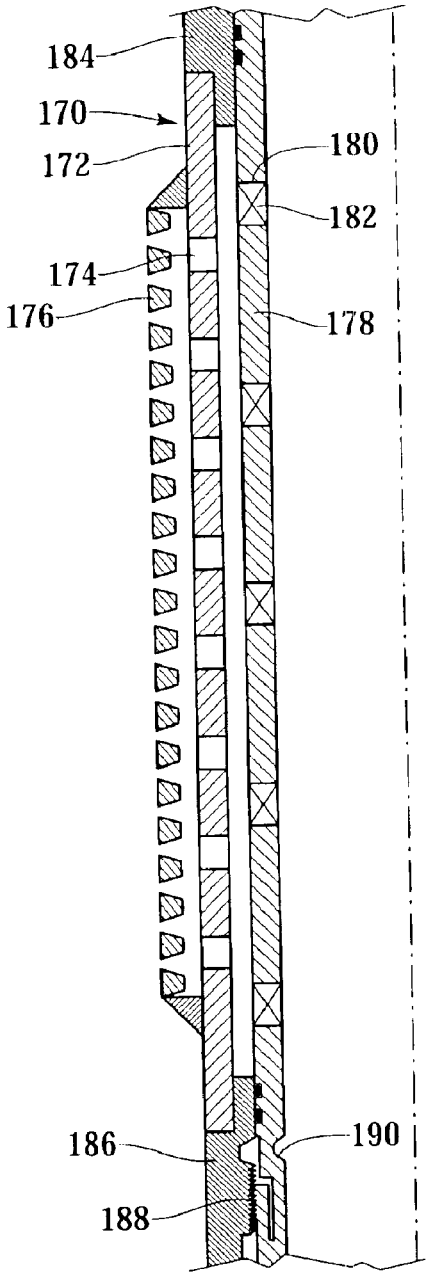
FIG. 7 is a cross sectional view of an alternate embodiment of a sand control screen assembly of the present invention having a retrievable internal isolation member including a plurality of one-way valves.

Referring now to FIG. 7, therein is depicted a sand control screen assembly that is generally designated 170. Sand control screen assembly 170 includes base pipe 172 that has a plurality of openings 174, a plurality of ribs (not pictured) and a screen wire 176. Together, the ribs and screen wire 176 form a sand control screen jacket that is attached to base pipe 172 by welding or other suitable techniques. Positioned within base pipe 172 is an internal isolation member 178 that is retrievable. Internal isolation member 178 includes a plurality of openings 180.

One-way valves 182 are disposed within each opening 180 of internal isolation member 178 to prevent fluid flow from the interior to the exterior of the sand control screen assembly 170. In the illustrated embodiment, internal isolation member 178 sealing engages base pipe connectors 184, 186. In addition, internal isolation member 178 is initially connected to base pipe connector 186 by ratchet connection 188. Internal isolation member 178 includes a profile 190 that receives a matching profile of a retrieval tool which may be locked into profile 190 such that jarring in the uphole direction on internal isolation member 178 will disengage ratchet connection 188 and allow internal isolation member 178 to be retrieved to the surface.

Figure 8A:
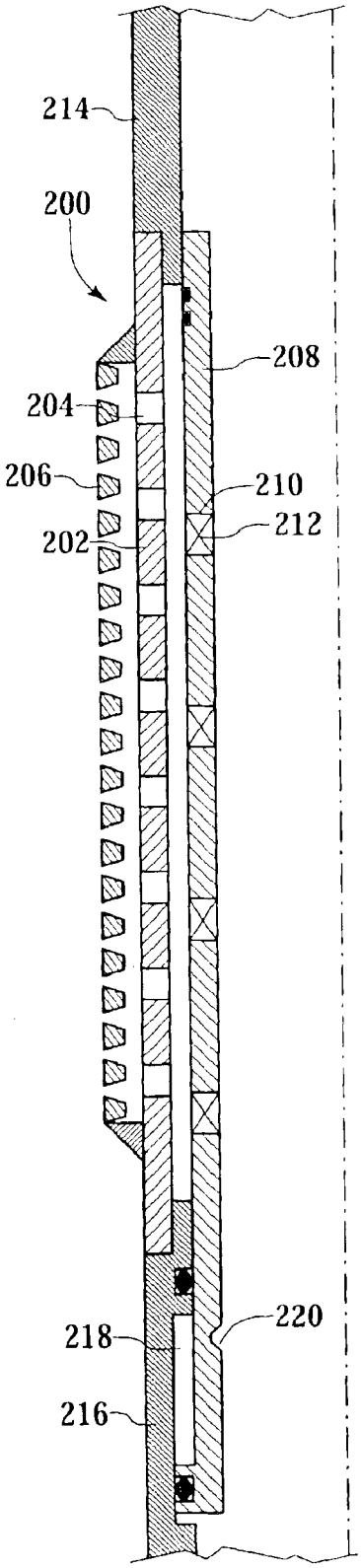
FIGS. 8A–8B are cross sectional views of a sand control screen assembly of the present invention having a shiftable and retrievable internal isolation member including a plurality of one-way valves.
Figure 8B:
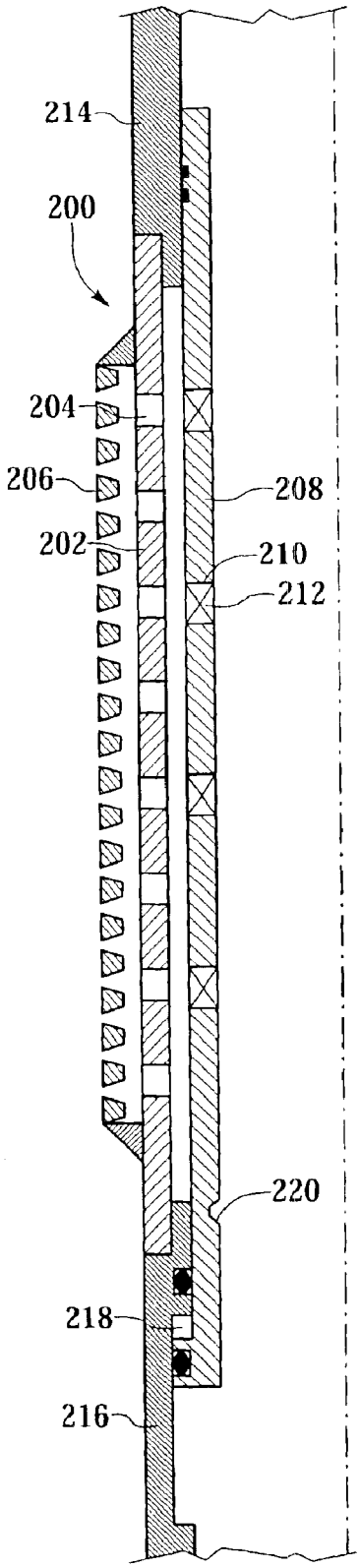

Referring now to FIGS. 8A–8B, therein is depicted a sand control screen assembly that is generally designated 200. Sand control screen assembly 200 includes base pipe 202 that has a plurality of openings 204, a plurality of ribs (not pictured) and a screen wire 206. Together, the ribs and screen wire 206 form a sand control screen jacket that is attached to base pipe 202 by welding or other suitable techniques. Positioned within base pipe 202 is an internal isolation member 208 that is retrievable. Internal isolation member 208 includes a plurality of openings 210.

One-way valves 212 are disposed within each opening 210 of internal isolation member 208 to prevent fluid flow from the interior to the exterior of the sand control screen assembly 200. In the illustrated embodiment, internal isolation member 208 selectively sealing engages base pipe connector 214 and sealing engages base pipe connector 216 forming chamber 218 therebetween. Internal isolation member 208 includes a profile 220.

In the illustrated embodiment, internal isolation member 208 operates as a sliding sleeve between the positions depicted in FIGS. 8A and 8B. Internal isolation member 208 may be operated between these positions in a manner that is well known in the art such as by connecting a mechanical shifter into profile 220, operating an electrical shifter or by using differential pressure between chamber 218 and the interior of sand control screen assembly 200. When internal isolation member 208 is in the non operating position depicted in FIG. 8A, fluid may flow from the interior to the exterior and from the exterior to the interior of sand control screen assembly 200 as no seal is present between internal isolation member 208 and base pipe connector 214. When internal isolation member 208 is in the operating position depicted in FIG. 8B, however, fluid flow is prevented from the interior to the exterior of sand control screen assembly 200 as a seal is present between internal isolation member 208 and base pipe connector 214 and one-way valves 212 are present. In addition, internal isolation member 178 may be retrieved to the surface by engaging a retrieval tool into profile 220.

Figure 9A:
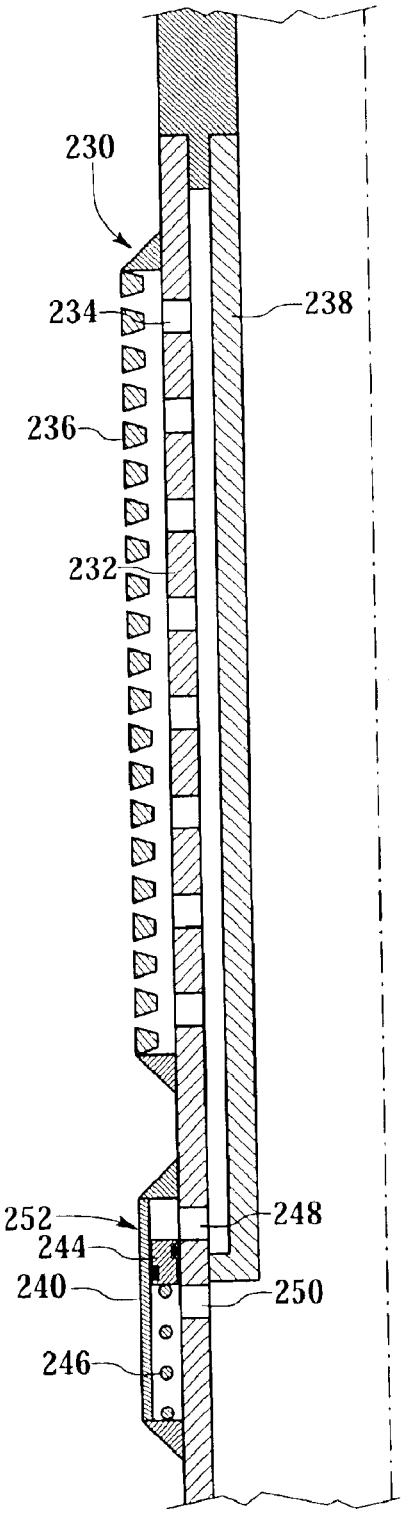
FIGS. 9A–9B are cross sectional views of a sand control screen assembly of the present invention having an internal isolation member and a bypass pathway.
Figure 9B:
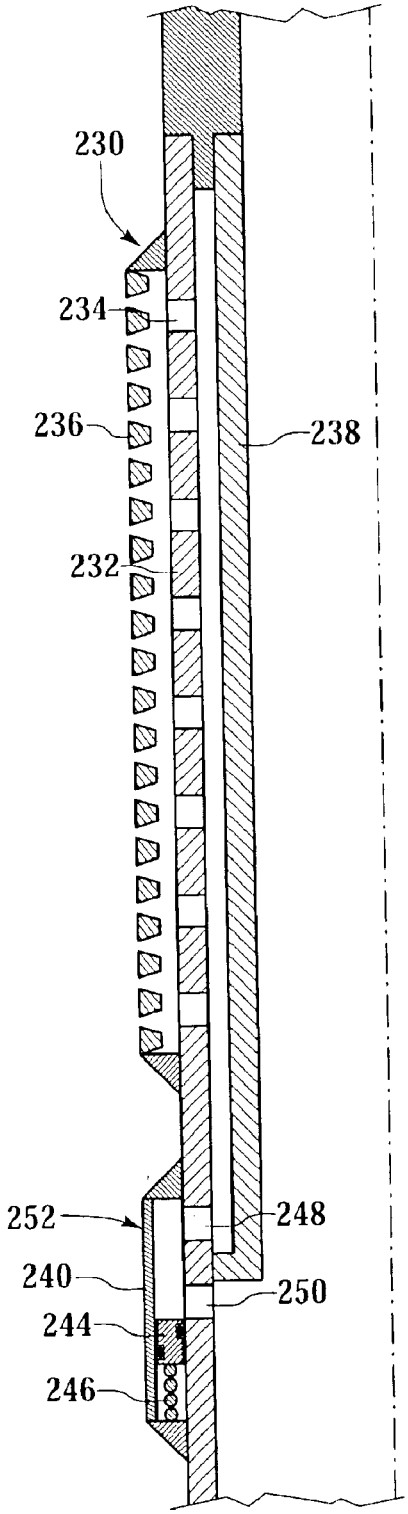

Referring now to FIG. 9A-9B, therein is depicted another embodiment of a sand control screen assembly of the present invention that is generally designated 230. Sand control screen assembly 230 includes base pipe 232 that has a plurality of openings 234, a plurality of ribs (not pictured) and a screen wire 236. Together, the ribs and screen wire 236 form a sand control screen jacket that is attached to base pipe 232 by welding or other suitable techniques. Positioned within base pipe 232 is an internal isolation member 238. Coupled to the exterior of base pipe 232 is a housing member 240. Disposed between housing member 240 and base pipe 232 is an annular sliding sleeve 244 having a pair of seals positioned thereon. Also disposed between housing member 240 and base pipe 232 is a spiral wound compression spring 246 that biases sliding sleeve 244 toward the sand control screen jacket. Housing member 240 is positioned adjacent to openings 248, 250 in base pipe 232.

Together, spring 246, sliding sleeve 244, housing member 240 and base pipe 232 form an annular one-way valve 252 that prevents fluid flow from the interior to the exterior of sand control screen assembly 230, as best seen in FIG. 9A, and is actuatable to allow fluid flow from the exterior to the interior of sand control screen assembly 230, as best seen in FIG. 9B. Specifically, in the fluid loss prevention configuration depicted in FIG. 9A, the bias force of spring 246 and the force created by differential pressure across sliding sleeve 244 between the interior and the exterior of sand control screen assembly 230 both act on sliding sleeve 244 such that sliding sleeve 244 sealingly engages housing member 240 and base pipe 232, thereby preventing fluid flow from the interior to the exterior of sand control screen assembly 230.

During production, however, production fluids are allowed to flow from the exterior to the interior of sand control screen assembly 230 through the fluid flow path created within sand control screen assembly 230. Specifically, the production fluid flows through the gaps between screen wire 236 and openings 234 in base pipe 232, travels in the annulus between base pipe 232 and internal isolation member 238, through opening 248 to shift sliding sleeve 244 by compressing spring 246, then travels through opening 250 into the interior of sand control screen 230.

It should be noted that following the treatment processes wherein fluid flow from the interior to the exterior of sand control screen assembly 230 is prevented, the ability to flow fluids from the interior to the exterior of sand control screen assembly 230 may be desirable, for example, to perform an acid treatment. Accordingly, one-way valve 252 may be designed to lock out or be rendered inoperable under certain conditions such that one-way valve 252 no longer prevent fluid flow from the interior to the exterior of sand control screen assembly 230. In such cases, after one-way valve 252 have been operated into the lock out position, fluid flow is allowed from the exterior to the interior and from the interior to the exterior of sand control screen assembly 230. One-way valve 252 may be operated to a locking out position by for example, exposing one-way valves 252 to a differential pressure above a predetermined threshold, by mechanical means or the like.

Figure 10:
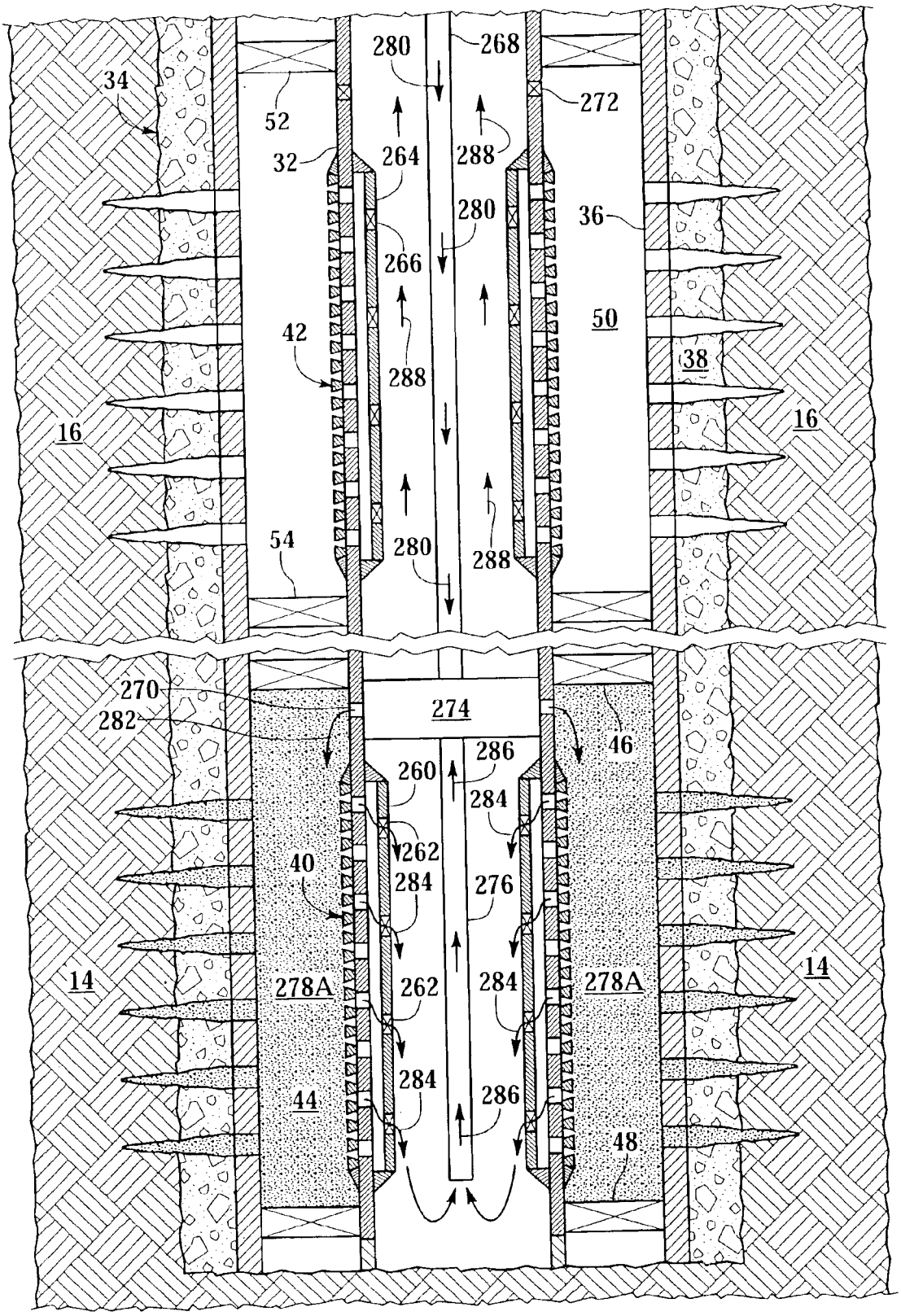
FIG. 10 is a half sectional view of a downhole production environment including a pair of sand control screen assemblies of the present invention during a first phase of a downhole treatment process.

Referring now to FIG. 10, therein is depicted in more detail the downhole environment described above with reference to FIG. 1 during a treatment process such as a gravel pack, a fracture operation, a frac pack or the like. As illustrated, sand control screen assembly 40 including internal isolation member 260 having one-way valves 262, is positioned within casing 36 and is adjacent to formation 14. Likewise, sand control screen assembly 42 including internal isolation member 264 having one-way valves 266, is positioned within casing 36 and is adjacent to formation 16. A service tool 268 is positioned within the work string 32.

To begin the completion process, production interval 44 adjacent to formation 14 is isolated. Packer 46 seals the near or uphole end of production interval 44 and packer 48 seals the far or downhole end of production interval 44. Likewise, production interval 50 adjacent to formation 16 is isolated. Packer 52 seals the near end of production interval 50 and packer 54 seals the far end of production interval 50. Work string 32 includes cross-over ports 270, 272 that provide a fluid communication path from the interior of work string 32 to production intervals 44, 50, respectively. Preferably, fluid flow through cross-over ports 270, 272 is controlled by suitable valves that are opened and closed by conventional means. Service tool 268 includes a cross-over assembly 274 and a wish pipe 276.

Next, the desired treatment process may be performed. As an example, when the treatment process is a fracture operation, the objective is to enhance the permeability of the treated formation by delivering a fluid slurry containing proppants at a high flow rate and in a large volume above the fracture gradient of the formation such that fractures may be formed within the formation and held open by proppants. In addition, if the treatment process is a frac pack, after fracturing, the objective is to prevent the production of fines by packing the production interval with proppants. Similarly, if the treatment process is a gravel pack, the objective is to prevent the production of fines by packing the production interval with gravel, without fracturing the adjacent formation.

The following example will describe the operation of the present invention during a gravel pack operation. Sand control screen assemblies 40, 42 each have a filter medium associated therewith that is designed to allow fluid to flow therethrough but prevent particulate matter of sufficient size from flowing therethrough. The exact design of the filter medium of sand control screen assemblies 40, 42 is not critical to the present invention as long as it is suitably designed for the characteristics of the formation fluids and the treatment fluids. In addition, one-way valves 262, 266 of sand control screen assemblies 40, 42 may be of any suitable type so long as they prevent fluid flow from the interior to the exterior of sand control screens 40, 42.

During the gravel pack, a treatment fluid, in this case a fluid slurry containing gravel 278, is pumped downhole in service tool 268, as indicated by arrows 280, and into production interval 44 via cross-over assembly 274, as indicated by arrows 282. As the fluid slurry containing gravel 278 travels to the far end of production interval 44, gravel 278 drops out of the slurry and builds up from formation 14, filling the perforations and production interval 44 around sand control screen assembly 40 forming gravel pack 278A. While some of the carrier fluid in the slurry may leak off into formation 14, the remainder of the carrier fluid passes through sand control screen assembly 40 and through one-way valves 262, as indicated by arrows 284. The fluid flowing back through sand control screen assembly 40 enters wash pipe 276, as indicated by arrows 286, passes through cross-over assembly 274 and flows back to the surface, as indicated by arrows 288.

Figure 11:
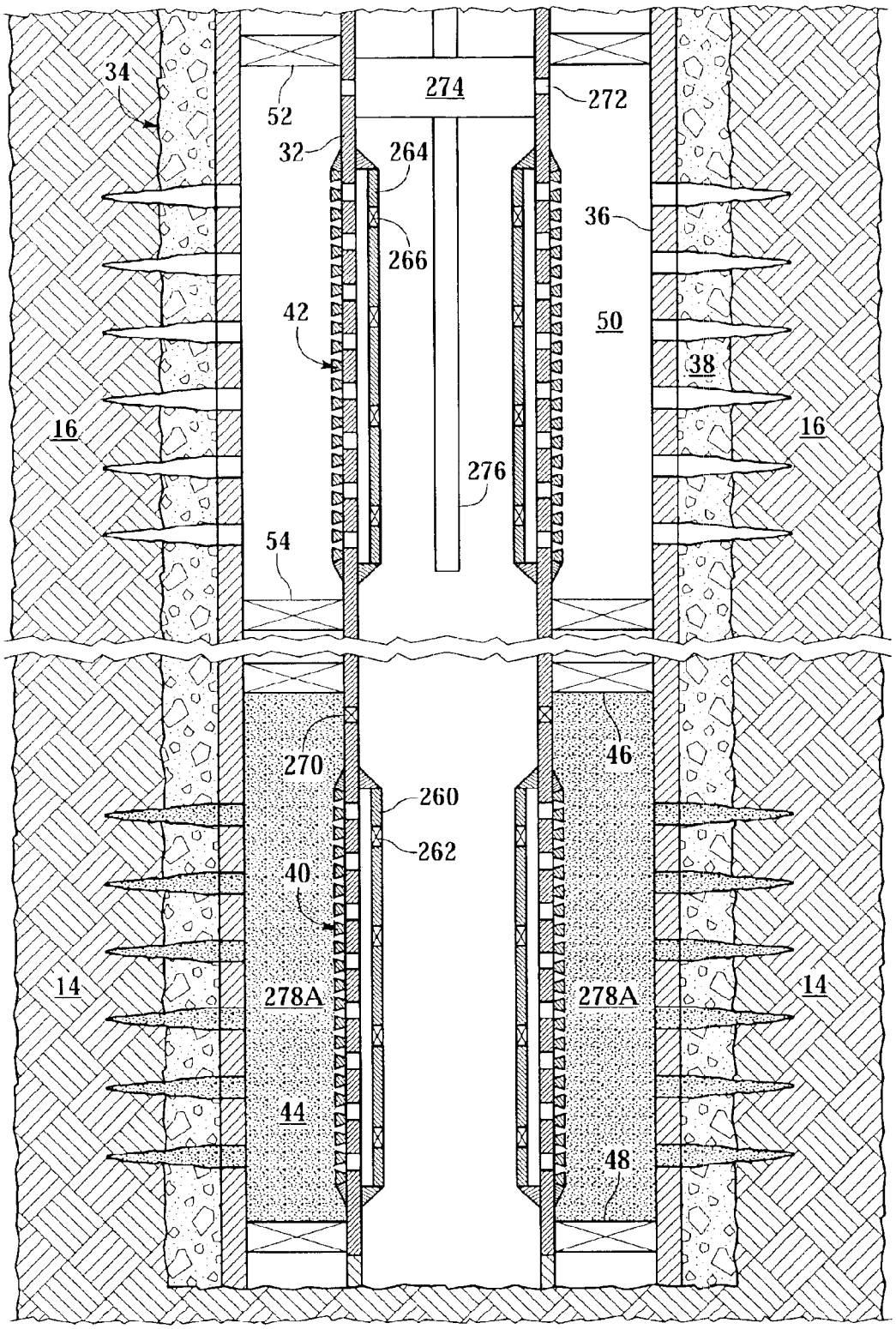
FIG. 11 is a half sectional view of a downhole production environment including a pair of sand control screen assemblies of the present invention during a second phase of a downhole treatment process.

After the gravel packing operation of production interval 44 is complete, service tool 268 including cross-over assembly 274 and wash pipe 276 may be moved uphole such that other production intervals may be gravel packed, such as production interval 50, as best seen in FIG. 11. As the distance between formation 14 and formation 16 may be hundreds or even thousands of feet and as there may be any number of production intervals that require gravel packing, there may be a considerable amount of time between the gravel packing of production interval 44 and eventual production from formation 14. It has been found that in conventional completions, considerable fluid loss may occur from the interior of sand control screen assembly 40 through gravel pack 278 and into formation 14. This fluid loss is not only costly but may also damage gravel pack 278, formation 14 or both. Using the sand control screen assemblies of the present invention, however, prevents such fluid loss due to one-way valves 262 in internal isolation member 260 positioned within sand control screen assembly 40. Accordingly, using the sand control screen assemblies of the present invention not only save the expense associated with fluid loss but also protect gravel pack 278 and formation 14 from the damage caused by fluid loss.

Figure 12:
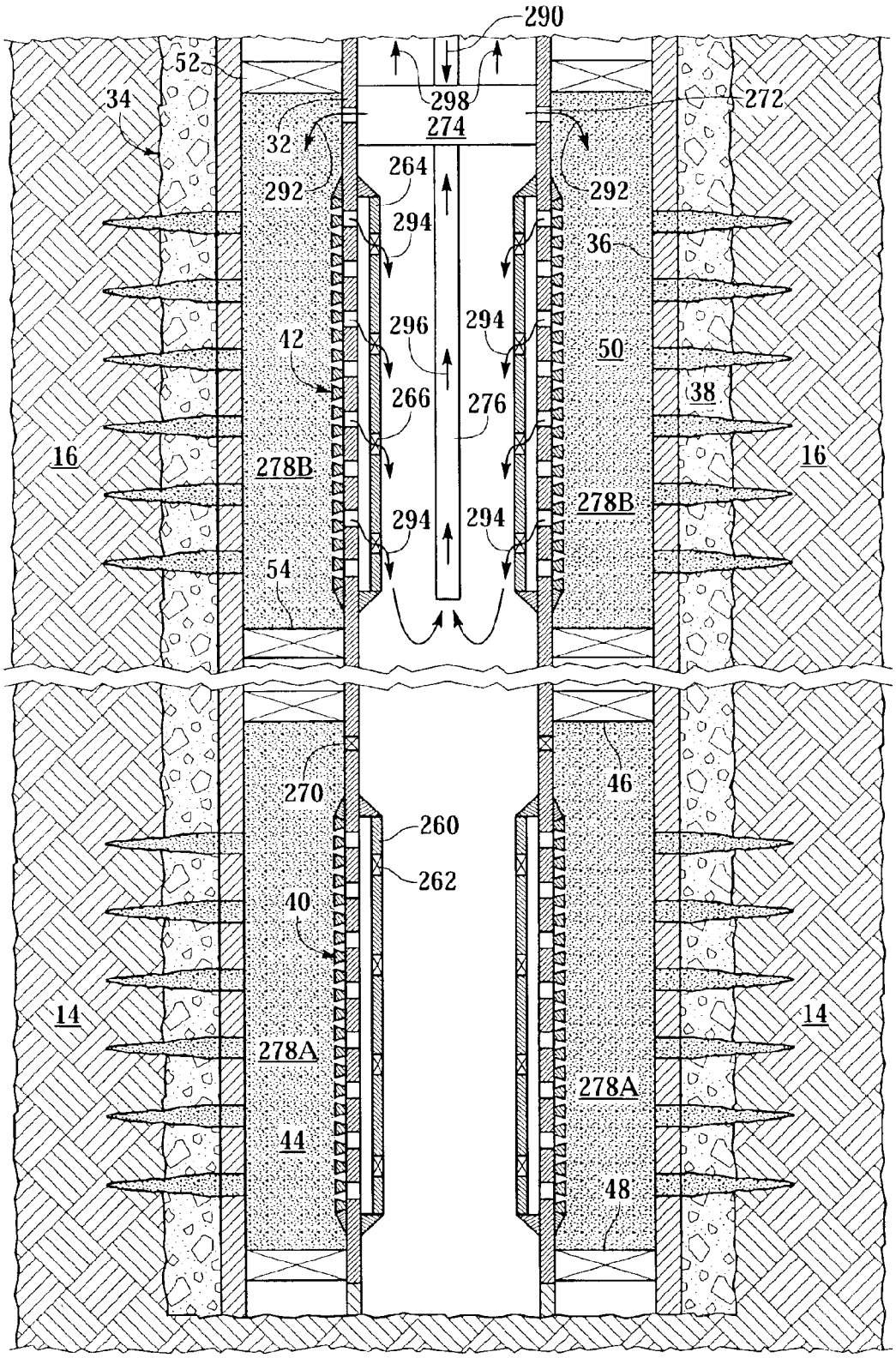
FIG. 12 is a half sectional view of a downhole production environment including a pair of sand control screen assemblies of the present invention during a third phase of a downhole treatment process.

Referring to FIG. 12, the process of gravel packing production interval 50 is depicted. The fluid slurry containing gravel 278 is pumped downhole through work string 32, as indicated by arrows 290, and into production interval 50 via cross-over assembly 274 and cross-over ports 272, as indicated by arrows 292. As the fluid slurry containing gravel 278 travels to the far end of production interval 50, the gravel 278 drops out of the slurry and builds up from formation 16, filling the perforations and production interval 50 around sand control screen assembly 42 forming gravel pack 278B. While some of the carrier fluid in the slurry may leak off into formation 16, the remainder of the carrier fluid passes through sand control screen assembly 42 and through one-way valves 266, as indicated by arrows 294. The fluid flowing back through sand control screen assembly 42 enters wash pipe 276, as indicated by arrows 296, and passes through cross-over assembly 274 for return to the surface, as indicated by arrows 298. Once gravel pack 278B is complete, cross-over assembly 274 may again be repositioned uphole to gravel pack additional production intervals or retrieved to the surface. As explained above, using sand control screen assembly 42 prevents fluid loss from the interior of sand control screen assembly 42 to formation 16 during such subsequent operations.

As should be apparent to those skilled in the art, even though FIGS. 10–12 present the treatment of multiple intervals of a wellbore in a vertical orientation with packers at the top and bottom of the production interval, these figures are intended to also represent wellbores that have alternate directional orientations such as inclined wellbores and horizontal wellbores. In the horizontal orientation, for example, packer 46 is at the heel of production interval 44 and packer 48 is at the toe of production interval 44. Likewise, while multiple production intervals have been described as being treated during a single trip, the methods described above are also suitable for treating a single production interval traversed by a wellbore or may be accomplished in multiple trips into a wellbore.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly positionable within a wellbore comprising:

a base pipe having at least one opening that allows fluid flow therethrough;

a filter medium positioned about the exterior of the base pipe, the filter medium selectively allowing fluid flow therethrough and preventing particulate flow of a predetermined size therethrough;

an internal isolation member positioned within the base pipe, the internal isolation member having at least one opening; and a one-way valve operably associated with the opening of the internal isolation member that controls fluid flow through the opening of the internal isolation member.

2. The sand control screen assembly as recited in claim 1 wherein the one-way valve prevents fluid flow from the interior to the exterior of the sand control screen assembly and is actuatable to allow fluid flow from the exterior to the interior of the sand control screen assembly.

3. The sand control screen assembly as recited in claim 1 wherein the one-way valve is disposed at least partially within the opening of the internal isolation member.

4. The sand control screen assembly as recited in claim 3 wherein the one-way valve is flush mounted within the opening of the internal isolation member.

5. The sand control screen assembly as recited in claim 3 wherein the one-way valve extends partially inwardly into the internal isolation member.

6. The sand control screen assembly as recited in claim 3 wherein the one-way valve extends partially outwardly from the internal isolation member.

7. The sand control screen assembly as recited in claim 3 wherein the one-way valve is a ball and seat type one-way valve.

8. The sand control screen assembly as recited in claim 1 wherein the one-way valve is selectively operable to a disabled configuration such that fluid flow from the interior to the exterior of the sand control screen assembly is enabled.

9. The sand control screen assembly as recited in claim 1 wherein the internal isolation member is retrievable from within the base pipe such that fluid flow from the interior to the exterior of the sand control screen assembly is enabled.

10. The sand control screen assembly as recited in claim 1 wherein the internal isolation member is axially shiftable relative to the base pipe between operating and non operating positions.

11. A sand control screen assembly positionable within a wellbore comprising:

a base pipe having at least one opening that allows fluid flow therethrough;

a filter medium positioned about the exterior of the base pipe, the filter medium selectively allowing fluid flow therethrough and preventing particulate flow of a predetermined size therethrough;

an internal isolation member positioned within the base pipe, the internal isolation member having at least one opening; and a one-way valve positioned at least partially within the opening of the internal isolation member that prevents fluid flow from the interior to the exterior of the sand control screen assembly and is actuatable to allow fluid flow from the exterior to the interior of the sand control screen assembly.

12. The sand control screen assembly as recited in claim 11 wherein the one-way valve is flush mounted within the opening of the internal isolation member.

13. The sand control screen assembly as recited in claim 11 wherein the one-way valve extends partially inwardly into the internal isolation member.

14. The sand control screen assembly as recited in claim 11 wherein the one-way valve extends partially outwardly from the internal isolation member.

15. The sand control screen assembly as recited in claim 11 wherein the one-way valve is a ball and seat type one-way valve.

16. The sand control screen assembly as recited in claim 11 wherein the one-way valve is selectively operable to a disabled configuration such that fluid flow from the interior to the exterior of the sand control screen assembly is enabled.

17. The sand control screen assembly as recited in claim 11 wherein the internal isolation member is retrievable from within the base pipe such that fluid flow from the interior to the exterior of the sand control screen assembly is enabled.

18. The sand control screen assembly as recited in claim 11 wherein the internal isolation member is axially shiftable relative to the base pipe between operating and non operating positions.

19. A sand control screen assembly positionable within a wellbore comprising:

a base pipe having at least one opening that allows fluid flow therethrough;

a filter medium positioned about the exterior of the base pipe, the filter medium selectively allowing fluid flow therethrough and preventing particulate flow of a predetermined size therethrough;

an internal isolation member positioned within the base pipe, the internal isolation member having at least one opening; and a one-way valve positioned at least partially within the opening of the internal isolation member, the one-way valve having a first operating mode wherein the one-way valve prevents fluid flow from the interior to the exterior of the sand control screen assembly and is actuatable to allow fluid flow from the exterior to the interior of the sand control screen assembly and a second operating mode wherein the one-way valve allows fluid flow from the interior to the exterior and from the exterior to the interior of the sand control screen assembly.

20. The sand control screen assembly as recited in claim 19 wherein the one-way valve is operated from the first operating mode to the second operating mode in response to a preselected differential pressure.

21. A sand control screen assembly positionable within a wellbore comprising:

a base pipe having at least one opening that allows fluid flow therethrough;

a filter medium positioned about the exterior of the base pipe, the filter medium selectively allowing fluid flow therethrough and preventing particulate flow of a predetermined size therethrough;

an internal isolation member positioned within the base pipe and forming a first annular region therewith; and a one-way valve positioned in a fluid flow path between the exterior and the interior of the sand control screen assembly that prevents fluid flow from the interior to the exterior of the sand control screen assembly and is actuatable to allow fluid flow from the exterior to the interior of the sand control screen assembly.

22. The sand control screen assembly as recited in claim 21 wherein the one-way valve further comprises a sliding sleeve and a spring.

23. The sand control screen assembly as recited in claim 21 wherein the one-way valve is positioned to the exterior of the base pipe.

24. The sand control screen assembly as recited in claim 21 further comprising a housing positioned exteriorly around the base pipe forming a second annular region therewith and wherein the one-way valve is positioned between the housing and the base pipe.

25. The sand control screen assembly as recited in claim 24 wherein the fluid flow path between the exterior and the interior of the sand control screen assembly further comprises the filter medium, the opening of the base pipe, the first annular region and the second annular region.

26. A downhole treatment method comprising the steps of:

locating a sand control screen assembly within a production interval of a wellbore, the sand control screen assembly including a base pipe having at least one opening, a filter medium positioned about an exterior of the base pipe and an internal isolation member positioned within the base pipe that includes at least one opening;

pumping a treatment fluid into the production interval; and preventing fluid flow from the interior to the exterior of the sand control screen assembly with a one-way valve operably associated with the at least one opening of the internal isolation member that controls fluid flow therethrough.

27. The method as recited in claim 26 wherein the step of preventing fluid flow from the interior to the exterior of the sand control screen assembly further comprises positioning the one-way valve at least partially within the at least one opening of the internal isolation member.

28. The method as recited in claim 26 further comprising selectively operating the one-way valve to a disabled configuration allowing fluid flow from the interior to the exterior of the sand control screen assembly.

29. The method as recited in claim 28 wherein the step of operating the one-way valve to a disabled configuration further comprises exposing the one-way valve to a differential pressure above a preselected level.

30. The method as recited in claim 26 further comprising the step of allowing fluid flow from the exterior to the interior of the sand control screen assembly through the one-way valve.

31. The method as recited in claim 26 further comprising the step of continuing to prevent fluid flow from the interior to the exterior of the sand control screen assembly after terminating the pumping of the treatment fluid into the production interval.

32. The method as recited in claim 26 further comprising retrieving the internal isolation member from within the base pipe such that fluid flow from the interior to the exterior of the sand control screen assembly is enabled.

33. The method as recited in claim 26 further comprising axially shifting the internal isolation member relative to the base pipe between operating and non operating positions.

34. A downhole treatment method comprising the steps of:

locating a sand control screen assembly within a production interval of a wellbore, the sand control screen assembly including a base pipe having at least one opening, filter medium positioned about an exterior of the base pipe and an internal isolation member positioned within the base pipe that includes at least one opening having a one-way valve operably associated therewith;

pumping a treatment fluid into the production interval and taking fluid returns from the exterior to the interior of the sand control screen assembly through the one-way valve;

preventing fluid loss from the interior to the exterior of the sand control screen assembly with the one-way valve; and allowing production fluid flow from the exterior to the interior of the sand control screen assembly through the one-way valve.

35. The method as recited in claim 34 further comprising selectively operating the one-way valve to a disabled configuration to allow fluid flow from the interior to the exterior of the sand control screen assembly.

36. The method as recited in claim 35 wherein the step of selectively operating the one-way valve to a disabled configuration further comprises exposing the one-way valve to a differential pressure above a preselected level.

37. The method as recited in claim 34 wherein the step of preventing fluid flow from the interior to the exterior of the sand control screen assembly further comprises positioning the one-way valve at least partially within the at least one opening of the internal isolation member.

* * * * *